United States Patent [19]

Hollemann

[11] 4,134,267

[45] Jan. 16, 1979

[54] METHOD AND DEVICE FOR UTILIZING WASTE HEAT

[76] Inventor: Karl Hollemann, Laubanerstrasse 10, 3207 Harsum 1/Borsum, Fed. Rep. of Germany

[21] Appl. No.: 687,351

[22] Filed: May 17, 1976

[51] Int. Cl.[2] ..... F01K 17/02

[52] U.S. Cl. ..... 60/648; 237/12.1; 237/13

[58] Field of Search ..... 237/12.1, 13; 60/648, 60/655, 685, 690, 693, 698

[56] References Cited

U.S. PATENT DOCUMENTS

| | | | |
|---|---|---|---|
| 379,283 | 3/1888 | Prall | 237/12.1 |
| 1,376,326 | 4/1921 | Evans | 237/12.1 |
| 2,189,895 | 2/1940 | Grutzner | 237/12.1 X |
| 2,593,963 | 4/1952 | Biggs | 60/655 |

*Primary Examiner*—Allen M. Ostrager

[57] ABSTRACT

For utilizing the waste heat from a thermal power station a plurality of annular zones are provided surrounding the power station, said zones having different temperature levels decreasing in discrete steps radially outwardly from zone to zone. Heat comsumption locations, each having a heat requirement appropriate to the temperature level of the zone in which it is located, are provided in each zone and connected to the power station and with each other by thermally insulated pipe conduits.

7 Claims, 1 Drawing Figure

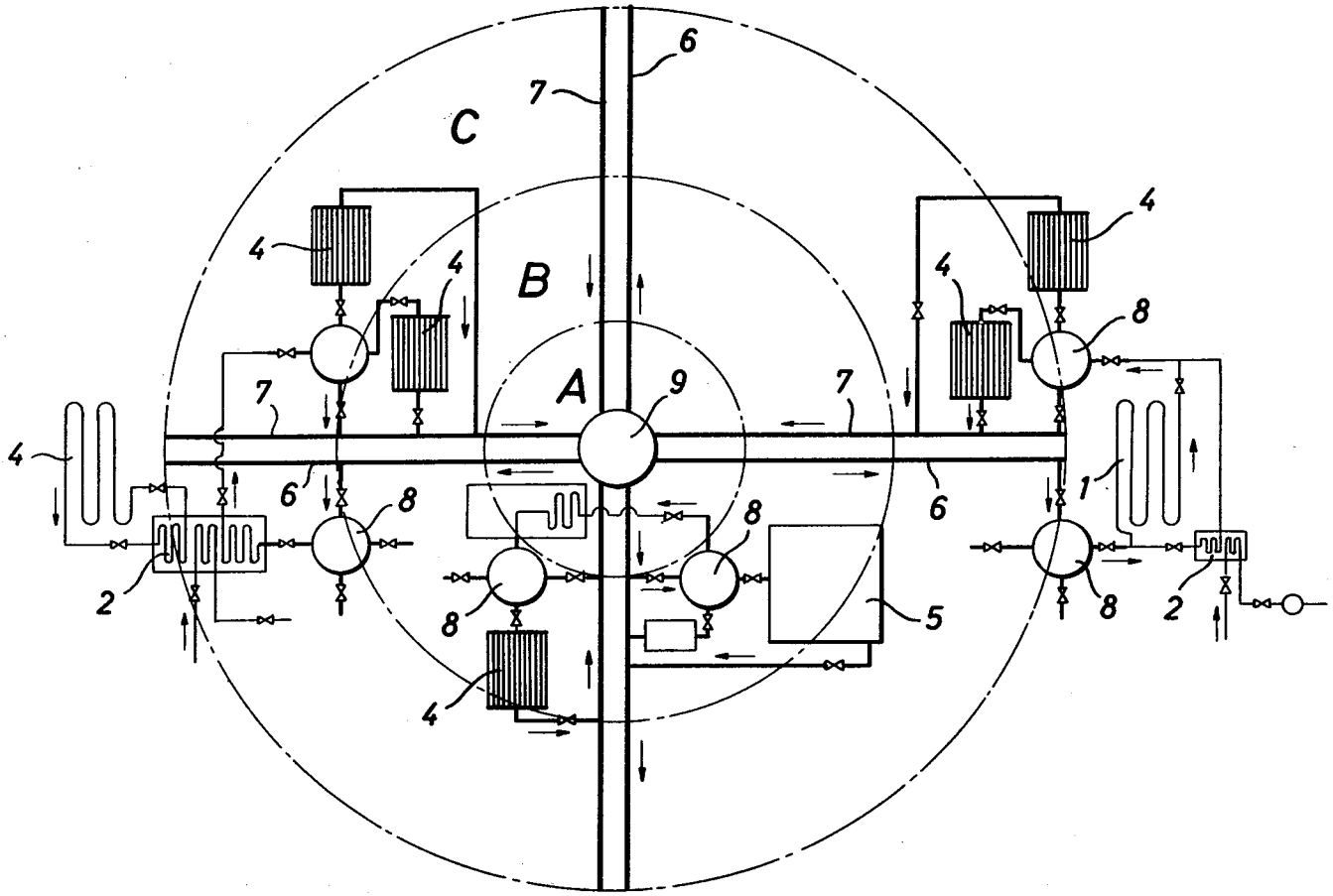
A
B
C
1
2
4
5
6
7
8
9

METHOD AND DEVICE FOR UTILIZING WASTE HEAT

The invention relates to a method and apparatus for improving the economic utilisation of waste heat from thermal power stations, which is largely either not utilised at all or only inadequately within the thermal power station.

The object of the invention is to eliminate this unsatisfactory position and to create a method and apparatus, by means of which the extensive waste heat derived from, for example, the cooling water, exhaust gases, exhaust steam or the like, is utilised to the largest extent which is practically possible, a substantial reduction in the operating costs (removal of the heat which has to be conducted away from the cooling water) is achieved in relation to the thermal power stations and a considerable saving in energy and costs is achieved in relation to numerous locations having continuous heat demands.

This is achieved by an arrangement in which, originating from the thermal power station, a plurality of annular zones are provided therearound on all sides and having stepwise reducing temperature levels, in which heat consumption locations having heat demands adapted to the temperature level of the annular zone concerned are provided, which are connected to the thermal power station and with each other by means of thermally insulated supply pipe conduits.

The inlets for the heating medium of the various heat consumers are connected to an upstream location of the common zone supply conduit for the heating medium and their heating medium exhausts are connected to a succeeding location of the zone supply conduit. In the outermost annular zone having the lowest temperature level the common heating medium supply conduit is directly connected to floor-, field- or road heating means or the like, before the heating medium is returned to the thermal power station via return conduits without thermal insulation and is there adapted to be reused as a cooling medium. The heating medium supply conduits to the zones and the return conduits are arranged in at least four radial directions perpendicular to each other.

Further particulars and advantages of the method and the apparatus are explained in greater detail in the description with reference to the drawing.

In the drawing an embodiment of the invention is shown diagrammatically (in its application to a thermal power station, the heat of whose cooling water is to be utilised in three zones). From the thermal power station 9 supply conduits for the heating medium having thermal insulation 6 pass through, for example, three concentric annular zones A, B, C, in radial, e.g. mutually perpendicular, directions. The supply conduits 6 may however extend at any other desired relative angle or in the form of arcs without sharp bends.

The first annular zone A has a maximum radial width of substantially 20 km and a temperature level of approximately 140° to 90° C. of the heating medium derived from the thermal power station, such as, for example, discharged cooling water, exhaust gases, exhaust steam or the like.

The second annular zone B has a maximum radial width of substantially 50 km and a temperature level of approximately 80° to 60° C. The third annular zone C has a maximum radial width of substantially 80 km and a temperature level of approximately 50° to 40° C.

At the outer perimeter of the third zone C the heating medium still has a temperature of approximately 14° to 18° C.

From the zone C at 50° to 40° C. the heating medium may be conducted into floor heating means 1, for floor-, road- or field surface heating 4 having a heat demand of approximately 28°–40° C., via heat exchangers 2, distribution stations or the like, before it is again returned, via return conduits without thermal insulation, to the thermal power station and used for cooling- or other purposes, or again conducted to the open water supplies, from which it was taken for cooling purposes, without damaging fish or other living creatures living therein.

In the first annular zone A the heating medium may, at 140° to 90° C., for example at an upstream location of the heating medium supply conduit 6 be branched off and supplied to normal radiator heaters or convection heaters 3, heat stores 5, hot water generating means, directly or via distribution stations 8. The discharge location of the heater which is to be heated is then to be connected to a succeeding location of the heating medium supply conduit, from which the heating medium is conducted to the heater, whence the heating medium is conducted to the next zone.

In the next annular zone heat demanding devices of correspondingly lower temperature level are connected to the heating medium supply conduit of this annular zone, and the discharge side of the heat demanding device is again connected to a succeeding location of the supply conduit of this annular zone.

In the third annular zone C or downstream thereof the heating medium may moreover be conducted directly into floor heating means 1, heat exchangers 5, field heating devices 4, road heating devices or the like, before its heat content is removed down to 14° to 18° C. and it is again conducted, via a return conduit without thermal insulation, to the thermal power station for cooling purposes, to the cooling water sources or for other purposes.

Where there are a plurality of thermal power stations in various districts, it is also possible for them to be interconnected by thermally insulated conduits, so that in the event of faults at one thermal power station, another thermal power station can assume responsibility for the supply of heating medium for the faulty power station. It is also possible for the zone regions of adjacent power stations to overlap, so that heat demanding devices in a zone C may, on account of their higher temperature levels, be connected to a zone A or B of an adjacent thermal power station having a higher temperature level.

In the annular zones, such as A, B having a higher temperature level the heating medium supply conduits of substantially 30 to 60 cm diameter and appropriate wall thickness and having superior thermal insulation of insulating foils or glass wool of appropriate thickness are used, whereas a hard foam coating suffices for the heating medium supply conduits of other annular zones. In the return conduits the water temperature from the start to the thermal power station is 14° to 18° C. without thermal insulation, and these return conduits do not require any thermal insulation. Desirably they are laid below the heating medium supply conduits. Spatially the distribution stations are united into buildings. They serve the purpose of, at the same time, adapting the conduit pressure and the heat demand to the heat demanding device.

Where the heating medium is utilised for floor heating, pipes of polypropylene or polyethylene of 2 mm wall thickness are preferably laid in a cement floor or the like and the heating medium flows therethrough at approximately 40° C. It is also possible to use copper piping of approximately 12 mm diameter and 1 mm wall thickness. The field area heating or warming device may be used for increasing the crop yield.

Heat stores for large scale space heating may be arranged below the cellar premises or in the lofts etc. and require thermal insulation of particularly good quality. They are inserted in parallel with the heating medium supply conduit and the heating medium flows through them continuously. They may also take the form of fire fighting tanks, to be available for fire fighting purposes in an emergency.

In order to provide selective admission, shutting-off or control of the through-flow of the heating medium, it is advisable to insert distribution stations etc., shut-off or control valves upstream and downstream of the various heat demanding devices. In the selection of the heat demanding devices which are to be connected to the heating medium supply, care should be taken that their temperature level agrees with the heat level of the annular zone concerned. By inserting heat exchangers, it is also possible to connect heat demanding devices of higher temperature level in an annular zone of lower temperature level to an adjacent annular zone of another power station and having a higher temperature level.

The details of the embodiment of heat utilisation apparatus illustrated and described may be modified in a variety of ways for adapting it to the conditions met with in practice, without departing from the scope of the invention.

I claim:

1. An arrangement for utilizing the waste heat from a thermal power station, comprising in combination: a thermal power station, a plurality of annular zones surrounding said power station, said zones having different temperature levels decreasing in discrete steps radially outwardly from zone to zone, at least one heat consumption location in each said zone having a heat requirement appropriate to the temperature level of the zone in which it is located, and thermally insulated pipe conduits connecting said locations to said power station and with each other; said zones receiving heat from said power station and supplying heat at different temperature levels to respective consumption levels in said zones.

2. The arrangement of claim 1 and including a common supply pipe, wherein inlets for a heating medium for supplying heat to said heat consumption locations are connected to an upstream location of said common supply pipe and exhausts from said heat consumption locations are connected to a downstream location of said supply pipe.

3. The arrangement of claim 2 and including heating means for heating a space (selected from the group comprising floors, fields and roads, and also including); return conduits without thermal insulation, said heating means being connected at least indirectly to said common supply pipe in the outermost one of said annular zones having the lowest temperature level, so that said heating medium transmits heat to said heating means before it is returned to the power station via said return conduits for re-use for cooling purposes.

4. The arrangement of claim 3, wherein of said supply conduits and said return conduits at least the former extend radially in at least four directions from the power station.

5. The arrangement of claim 3, wherein of said supply conduits and said return conduits at least the former extend radially in a star-formation from said power station.

6. The arrangement of claim 3, wherein all conduits for said heating medium which are arranged to supply said medium to said consumption locations are thermally insulated, said return conduits leading from the outermost annular zone to the power station having no thermal insulation.

7. The arrangement of claim 1, wherein a first said zone having a maximum radial width of substantially 20 km and a temperature level of substantially 140° to 90° C. is provided indirectly around said power station, a parallel annular zone having a maximum radial width of substantially 50 km and a temperature level of substantially 80° to 60° C. is provided radially outwardly adjacent said first zone, a further parallel annular zone having a maximum radial width of substantially 80 km and a temperature level of substantially 50° to 45° C. is provided outwardly radially adjacent said last-mentioned zone, heating means connected to terminal regions of said further parallel zones, and return conduits without thermal insulation being provided for returning said heating medium to the power station, the arrangement being such that, before the heating medium is returned to the power station in the form of a cooling medium via said return conduits at substantially 14° to 18° C., said medium transmits heat to said heating means.

* * * * *